US011462876B2

(12) United States Patent
Nakata

(10) Patent No.: US 11,462,876 B2
(45) Date of Patent: Oct. 4, 2022

(54) MANUFACTURING METHOD FOR ELECTRIC WIRE WITH TERMINAL AND MANUFACTURING DEVICE FOR ELECTRIC WIRE WITH TERMINAL

(71) Applicant: Yazaki Corporation, Tokyo (JP)

(72) Inventor: Hirohito Nakata, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 38 days.

(21) Appl. No.: 17/322,038

(22) Filed: May 17, 2021

(65) Prior Publication Data

US 2021/0367389 A1 Nov. 25, 2021

(30) Foreign Application Priority Data

May 19, 2020 (JP) ..... JP2020-087074

(51) Int. Cl.
*H01R 43/04* (2006.01)
*H01R 43/048* (2006.01)
*H01R 43/00* (2006.01)

(52) U.S. Cl.
CPC ..... *H01R 43/048* (2013.01); *H01R 43/005* (2013.01); *Y10T 29/49185* (2015.01)

(58) Field of Classification Search
CPC .... H01R 43/048; H01R 43/04; H01R 43/058; H01R 4/18; Y10T 29/49185
USPC ..... 29/863.33 M, 854, 857, 861, 715, 748, 29/753
See application file for complete search history.

(56) References Cited

U.S. PATENT DOCUMENTS

| | | | | |
|---|---|---|---|---|
| 9,543,689 | B2 * | 1/2017 | Sato | H01R 4/184 |
| 11,152,720 | B2 * | 10/2021 | Yamashita | H01B 7/2806 |
| 2019/0074603 | A1 * | 3/2019 | Furuhata | H01R 4/185 |
| 2019/0229443 | A1 | 7/2019 | Onuma | |

FOREIGN PATENT DOCUMENTS

| | | | |
|---|---|---|---|
| JP | 2016-181367 | A | 10/2016 |
| JP | 2018-045852 | A | 3/2018 |
| JP | 2019-075259 | A | 5/2019 |
| JP | 2019-129068 | A | 8/2019 |

* cited by examiner

*Primary Examiner* — Thiem D Phan
(74) *Attorney, Agent, or Firm* — Sughrue Mion, PLLC

(57) ABSTRACT

A manufacturing method for an electric wire with a terminal includes: a first resin supplying step for discharging a curable resin material for internal use through a discharge port at a nozzle distal end after being caulked and crimped, and infiltrating the curable resin material for internal use into gaps between elemental wires while pressing out air in the gaps; a second resin supplying step for discharging a curable resin material for external use through the discharge port at the nozzle distal end, and covering the core wire exposed part in which the curable resin material for internal use is filled into the gaps, a core wire connection body, and a coating connection body with the curable resin material for external use from the outside; and a resin curing step for curing the curable resin material for internal use and external use by operating a resin curing device.

12 Claims, 8 Drawing Sheets

MANUFACTURING METHOD FOR ELECTRIC WIRE WITH TERMINAL AND MANUFACTURING DEVICE FOR ELECTRIC WIRE WITH TERMINAL

CROSS-REFERENCE TO RELATED APPLICATION(S)

The present application claims priority to and incorporates by reference the entire contents of Japanese Patent Application No. 2020-087074 filed in Japan on May 19, 2020.

BACKGROUND OF THE INVENTION

1. Field of the Invention

The present invention relates to a manufacturing method for an electric wire with a terminal, and a manufacturing device for an electric wire with a terminal.

2. Description of the Related Art

In the related art, in some electric wires with a terminal, anticorrosive processing is performed on a terminal of the electric wire (hereinafter, referred to as an "electric wire terminal") and an electric wire connection body of a terminal metal fitting crimped onto the electric wire terminal. For example, Japanese Patent Application Laid-open No. 2016-181367 and Japanese Patent Application Laid-open No. 2019-129068 disclose an electric wire with a terminal in which a first resin is applied to a core wire exposed part of the electric wire terminal to infiltrate the first resin into gaps between elemental wires at the core wire exposed part. In the electric wire with a terminal disclosed in Japanese Patent Application Laid-open No. 2016-181367, the electric wire terminal and the electric wire connection body of the terminal metal fitting are covered with a second resin together with the first resin. In the electric wire with a terminal disclosed in Japanese Patent Application Laid-open No. 2019-129068, the electric wire terminal and the electric wire connection body of the terminal metal fitting are covered with the first resin, and a distal end side of the core wire exposed part with the first resin is covered with the second resin. The first resin and the second resin are curable resin materials that have viscosity and are cured under a predetermined condition, which is cured after being dripped or sprayed from a nozzle of a resin supply machine (refer to Japanese Patent Application Laid-open No. 2018-045852, and Japanese Patent Application Laid-open No. 2019-075259).

In the electric wire with a terminal, it is important to fill gaps between the elemental wires in a desired region of the electric wire terminal with the first resin for improving anticorrosive performance of a connection part between the electric wire and the terminal metal fitting. However, a conventional resin supply machine applies the first resin onto an outer peripheral surface of the core wire exposed part to infiltrate the first resin into the gaps between the elemental wires, so that air in the gaps hinders infiltration of the first resin. For example, in the conventional resin supply machine, an infiltration property with respect to the gaps between the elemental wires is enhanced by reducing viscosity of the first resin. On the other hand, the first resin before being cured may hardly remain in the gaps between the elemental wires. Thus, there is room for improvement in the conventional electric wire with a terminal regarding the anticorrosive performance of the connection part between the electric wire and the terminal metal fitting.

SUMMARY OF THE INVENTION

Thus, the present invention provides a manufacturing method for an electric wire with a terminal and a manufacturing device for an electric wire with a terminal capable of improving the anticorrosive performance.

In order to achieve the above mentioned object, a manufacturing method for an electric wire with a terminal according to one aspect of the present invention includes a crimping step for sandwiching and pressurizing, with a first die and a second die, an electric wire terminal of an electric wire including a core wire constituted of a plurality of elemental wires and a coating covering the core wire and an electric wire connection body of a terminal metal fitting including an inner wall surface on which the electric wire terminal is placed, calking and crimping a core wire connection body of the electric wire connection body onto a core wire exposed part of the core wire of the electric wire terminal, and calking and crimping a coating connection body connected to the core wire connection body of the electric wire connection body via a coupling body onto a coating terminal part of the coating of the electric wire terminal; a first resin supplying step for discharging a curable resin material for internal use through a discharge port at a nozzle distal end while pressing the nozzle distal end against an exposed part exposed from the electric wire connection body at the core wire exposed part after being caulked and crimped, and infiltrating the curable resin material for internal use into gaps between the elemental wires while pressing out air in the gaps at least at the core wire exposed part; a second resin supplying step for discharging a curable resin material for external use through the discharge port at the nozzle distal end to cover the core wire exposed part in which the curable resin material for internal use is filled into the gaps between the elemental wires, the core wire connection body, and the coating connection body, with the curable resin material for external use from the outside; and a resin curing step for curing the curable resin material for internal use and the curable resin material for external use by operating a resin curing device.

In order to achieve the above mentioned object, a manufacturing method for an electric wire with a terminal according to another aspect of the present invention includes a crimping step for sandwiching and pressurizing, with a first die and a second die, an electric wire terminal of an electric wire including a core wire constituted of a plurality of elemental wires and a coating covering the core wire and an electric wire connection body of a terminal metal fitting including an inner wall surface on which the electric wire terminal is placed, calking and crimping a core wire connection body of the electric wire connection body onto a core wire exposed part of the core wire of the electric wire terminal, and calking and crimping a coating connection body connected to the core wire connection body of the electric wire connection body via a coupling body onto a coating terminal part of the coating of the electric wire terminal; a first resin supplying step for discharging a curable resin material for internal use through a discharge port at a nozzle distal end of a first nozzle while pressing the nozzle distal end against an exposed part exposed from the electric wire connection body at the core wire exposed part after being caulked and crimped, and infiltrating the curable resin material for internal use into gaps between the elemental wires while pressing out air in the gaps at least at the core wire exposed part; a second resin supplying step for discharging a curable resin material for external use through a discharge port at a nozzle distal end of a second nozzle to cover the core wire exposed part in which the curable resin material for internal use is filled into the gaps between the elemental wires, the core wire connection body, and the coating connection body with the curable resin material for external use from the outside; and a resin curing step for curing the curable resin material for internal use and the curable resin material for external use by operating a resin curing device.

According to still another aspect of the present invention, in the manufacturing method for the electric wire with a terminal, it is preferable that at the first resin supplying step, the curable resin material for internal use is discharged through the discharge port at the nozzle distal end while the nozzle distal end smaller than an opening of the coupling body is pressed against the exposed part exposed from the opening.

According to still another aspect of the present invention, in the manufacturing method for the electric wire with a terminal, it is preferable that at the first resin supplying step, the curable resin material for internal use is filled into the gaps between the elemental wires of the core wire at least in an area from a position of the coupling body to a rear end position opposite to a distal end position on the coupling body side of the coating connection body.

In order to achieve the above mentioned object, a manufacturing device for an electric wire with a terminal according to still another aspect of the present invention includes a crimping machine that includes a first die and a second die between which an electric wire terminal of an electric wire including a core wire constituted of a plurality of elemental wires and a coating covering the core wire, and an electric wire connection body of a terminal metal fitting including an inner wall surface on which the electric wire terminal is placed are disposed, and is configured to sandwich and pressurize the electric wire terminal and the electric wire connection body with the first die and the second die to calk and crimp a core wire connection body of the electric wire connection body onto a core wire exposed part of the core wire of the electric wire terminal, and calk and crimp a coating connection body connected to the core wire connection body of the electric wire connection body via a coupling body onto a coating terminal part of the coating of the electric wire terminal; a resin supply machine that includes a nozzle for discharging a curable resin material for internal use and a curable resin material for external use through a discharge port at a nozzle distal end, and is configured to discharge the curable resin material for internal use through the discharge port at the nozzle distal end while pressing the nozzle distal end of the nozzle against an exposed part exposed from the electric wire connection body at the core wire exposed part after being caulked and crimped, infiltrate the curable resin material for internal use into gaps between the elemental wires while pressing out air in the gaps at least at the core wire exposed part, and cover the core wire exposed part in which the curable resin material for internal use is filled into the gaps between the elemental wires, the core wire connection body, and the coating connection body with the curable resin material for external use from the outside; and a resin curing device configured to cure the curable resin material for internal use and the curable resin material for external use.

In order to achieve the above mentioned object, a manufacturing device for an electric wire with a terminal according to still another aspect of the present invention includes a crimping machine that includes a first die and a second die between which an electric wire terminal of an electric wire including a core wire constituted of a plurality of elemental wires and a coating covering the core wire, and an electric wire connection body of a terminal metal fitting including an inner wall surface on which the electric wire terminal is placed are disposed, and is configured to sandwich and pressurize the electric wire terminal and the electric wire connection body with the first die and the second die to calk and crimp a core wire connection body of the electric wire connection body onto a core wire exposed part of the core wire of the electric wire terminal, and calk and crimp a coating connection body connected to the core wire connection body of the electric wire connection body via a coupling body onto a coating terminal part of the coating of the electric wire terminal; a first resin supply machine that includes a first nozzle for discharging a curable resin material for internal use through a discharge port at a nozzle distal end, and is configured to discharge the curable resin material for internal use through the discharge port at the nozzle distal end while pressing the nozzle distal end of the first nozzle against an exposed part exposed from the electric wire connection body at the core wire exposed part after being caulked and crimped, and infiltrate the curable resin material for internal use into gaps between the elemental wires while pressing out air in the gaps at least at the core wire exposed part; a second resin supply machine that includes a second nozzle for discharging a curable resin material for external use through a discharge port at a nozzle distal end, and is configured to discharge the curable resin material for external use through a discharge port at a nozzle distal end of the second nozzle, and cover the core wire exposed part in which the curable resin material for internal use is filled into the gaps between the elemental wires, the core wire connection body, and the coating connection body with the curable resin material for external use from the outside; and a resin curing device configured to cure the curable resin material for internal use and the curable resin material for external use.

According to still another aspect of the present invention, in the manufacturing device for the electric wire with a terminal, it is preferable that the nozzle distal end including the discharge port for the curable resin material for internal use is smaller than an opening of the coupling body from which the exposed part is exposed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
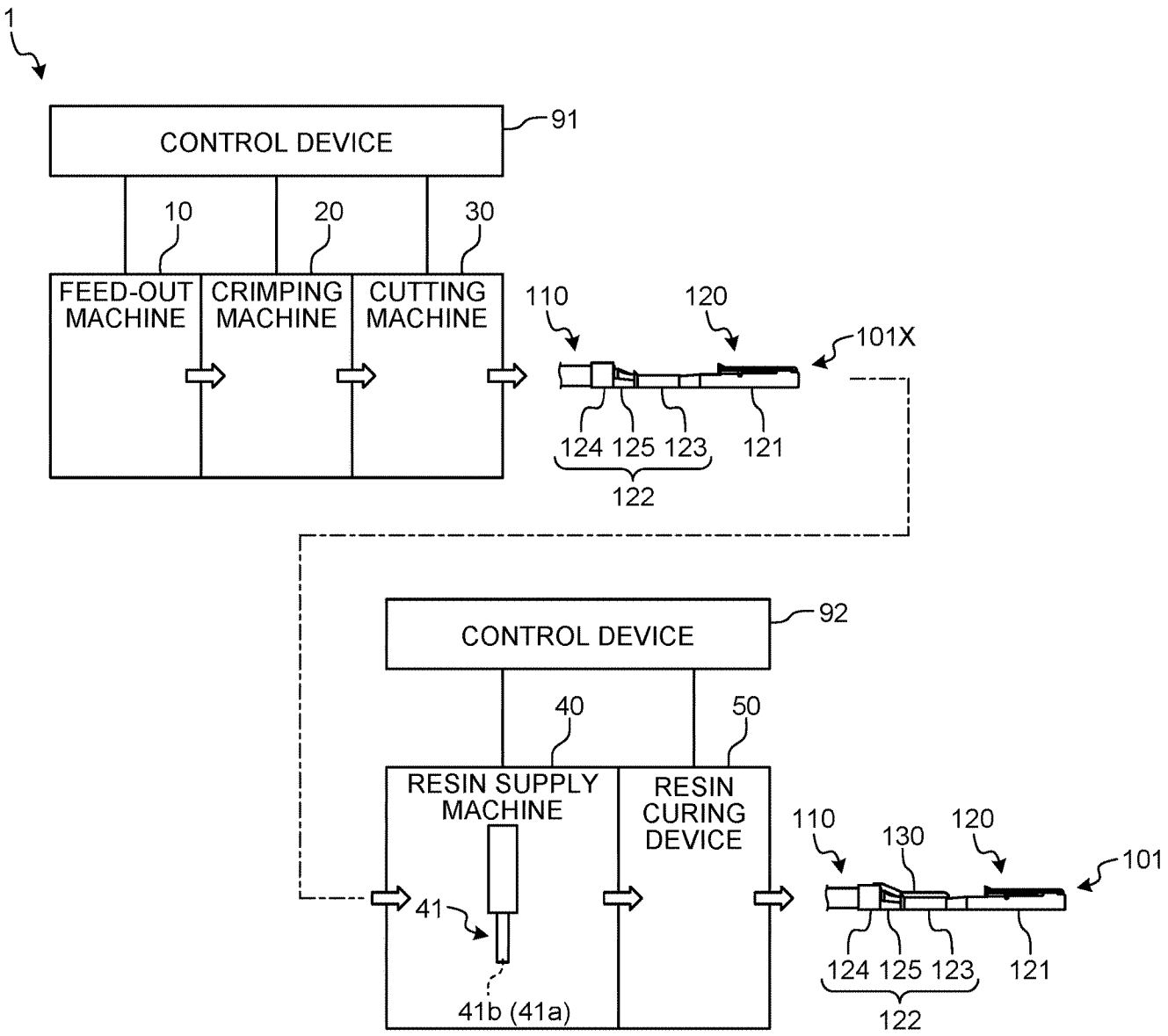
FIG. 1 is a block diagram illustrating a manufacturing device for an electric wire with a terminal.

The following describes an embodiment of a manufacturing method for an electric wire with a terminal and a manufacturing device for an electric wire with a terminal according to the present invention in detail based on the drawings. The present invention is not limited to the embodiment.

Embodiment

The following describes an embodiment of the manufacturing method for an electric wire with a terminal and the manufacturing device for an electric wire with a terminal according to the present invention based on FIG. 1 to FIG. 8.

The reference numeral 1 in FIG. 1 to FIG. 4 denotes the manufacturing device for an electric wire with a terminal according to the present embodiment. The reference numeral 101 in FIG. 1, FIG. 2, and FIG. 5 to FIG. 7 denotes the electric wire with a terminal according to the present embodiment.

First, the following describes the electric wire with a terminal 101 that is made by using the manufacturing device 1 according to the present embodiment and the manufacturing method using the manufacturing device 1. The electric wire with a terminal 101 includes an electric wire 110 and a terminal metal fitting 120 that are physically and electrically connected to each other (FIG. 1 to FIG. 7). Additionally, to enhance anticorrosive performance of a connection part between the electric wire 110 and the terminal metal fitting 120, the electric wire with a terminal 101 includes a water stop member 130 for preventing liquid such as water from entering the connection part (FIG. 1, and FIG. 5 to FIG. 7).

The electric wire 110 includes a core wire 111 and a coating 112 covering the core wire 111, and the coating 112 is stripped off from an electric wire terminal 110*a* to expose the core wire 111 (FIG. 2, FIG. 3, FIG. 5, and FIG. 6). The core wire 111 is configured by binding a plurality of elemental wires 113 constituted of conductive metal wire rods. The coating 112 is formed of insulating resin material that covers the core wire 111 of the electric wire terminal 110*a* except a core wire exposed part 111*a*. In the electric wire with a terminal 101 according to the present embodiment, the terminal metal fitting 120 is attached to the electric wire terminal 110*a*.

The terminal metal fitting 120 is formed of conductive material such as metal. The terminal metal fitting 120 is formed in a predetermined shape by press forming such as bending processing or cut processing on a metal plate as a base material, for example.

The terminal metal fitting 120 includes a terminal connection body 121 that is physically and electrically connected to a terminal connection body (not illustrated) of a counterpart terminal metal fitting (FIG. 1 to FIG. 3, FIG. 5, and FIG. 6). For example, one of the terminal connection body 121 of the terminal metal fitting 120 and the terminal connection body of the counterpart terminal metal fitting is formed in a female terminal shape, and the other one thereof is formed in a male terminal shape to be inserted to and engaged with each other.

The terminal metal fitting 120 also includes an electric wire connection body 122 connected to the electric wire terminal 110*a* (FIG. 1 to FIG. 6). The electric wire connection body 122 includes a core wire connection body 123 that is physically and electrically connected to the core wire exposed part 111*a*, a coating connection body 124 that is physically connected to a coating terminal part 112*a* of the coating 112 of the electric wire terminal 110*a*, and a coupling body 125 that couples the core wire connection body 123 with the coating connection body 124 with a gap to expose the core wire exposed part 111*a* between the core wire connection body 123 and the coating connection body 124.

The core wire connection body 123 described herein is physically and electrically connected to the core wire exposed part 111*a* by winding two barrel piece parts 123B (FIG. 2) connected to a bottom part 123A around the core wire exposed part 111*a* to be caulked and crimped. The core wire connection body 123 described herein after being caulked and crimped allows a distal end of the core wire exposed part 111*a* to project toward the terminal connection body 121 side from a distal end on the terminal connection body 121 of the core wire connection body 123 (FIG. 3, FIG. 5, and FIG. 6).

The coating connection body 124 described herein is physically connected to the coating terminal part 112*a* by winding two barrel piece parts 124B (FIG. 2) connected to a bottom part 124A around the coating terminal part 112*a* to be caulked and crimped. The coating connection body 124 described herein after being caulked and crimped allows a distal end of the coating terminal part 112*a* to project toward the coupling body 125 side from a distal end 124*a* on the coupling body 125 side of the coating connection body 124 (FIG. 3, FIG. 5, and FIG. 6).

Figure 3:
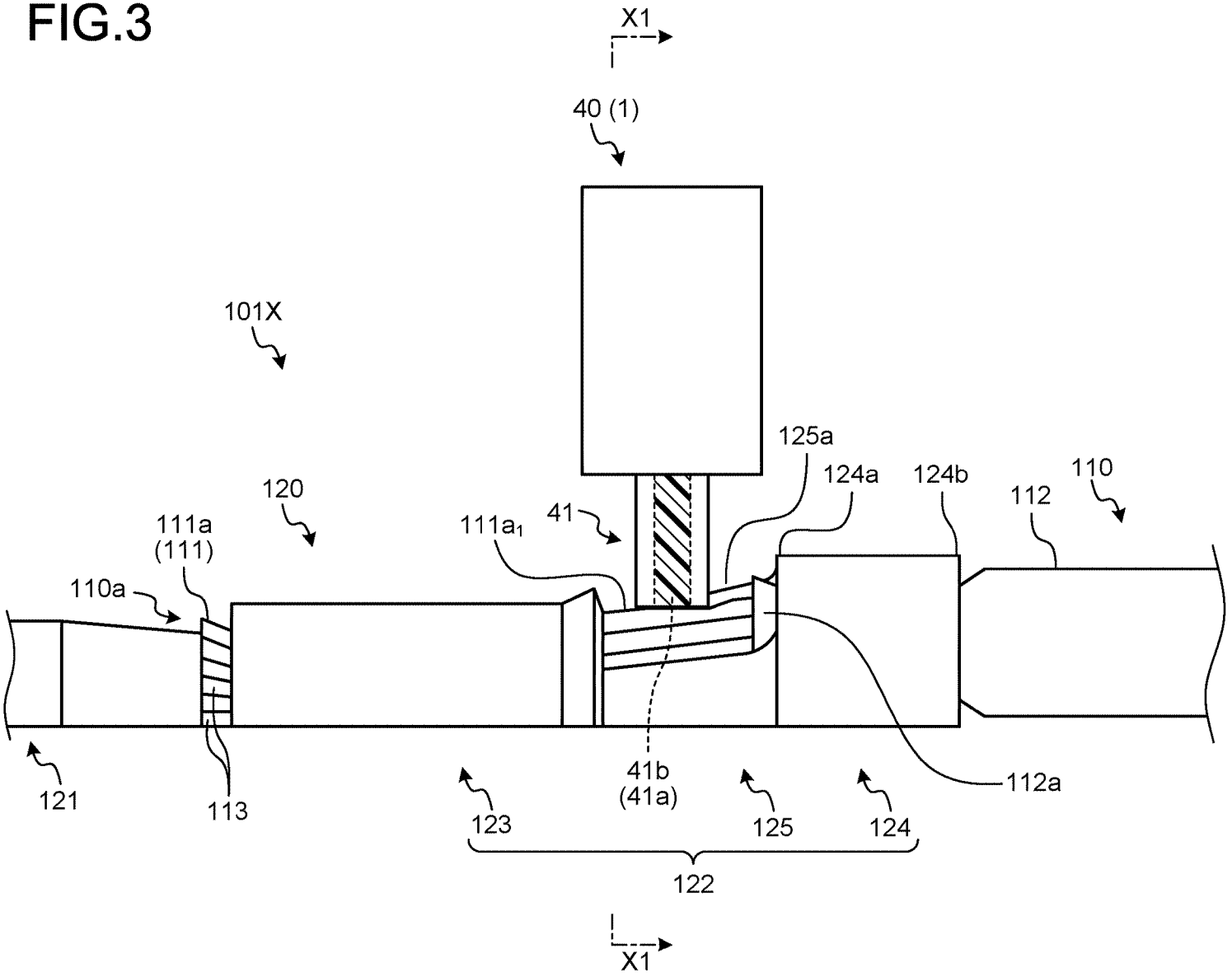
FIG. 3 is a side view illustrating a principal part of a first resin supply machine in the manufacturing device for an electric wire with a terminal.
Figure 4:
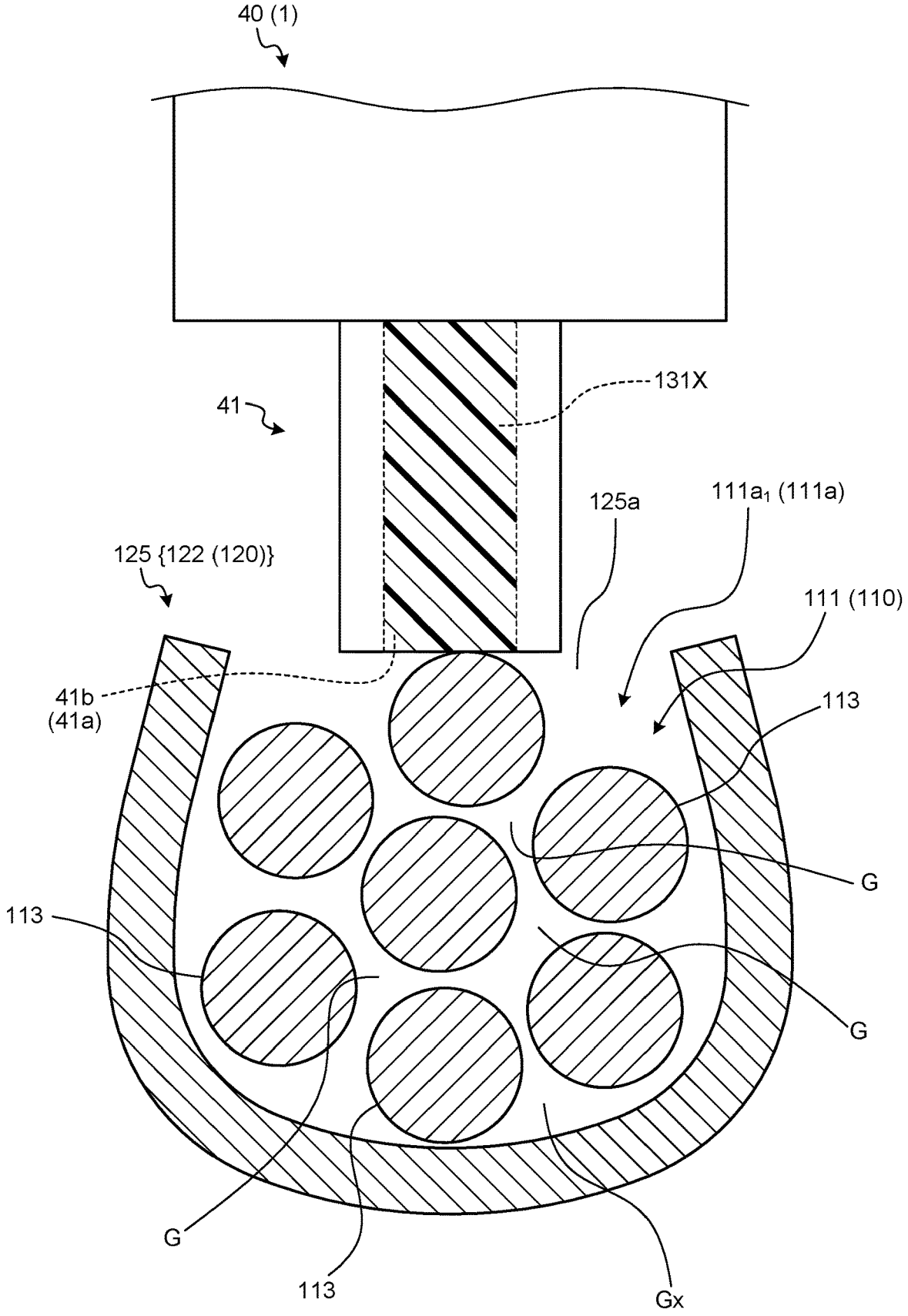
FIG. 4 is a diagram illustrating a principal part of a cross section along the line X1-X1 in FIG. 3.
Figure 5:
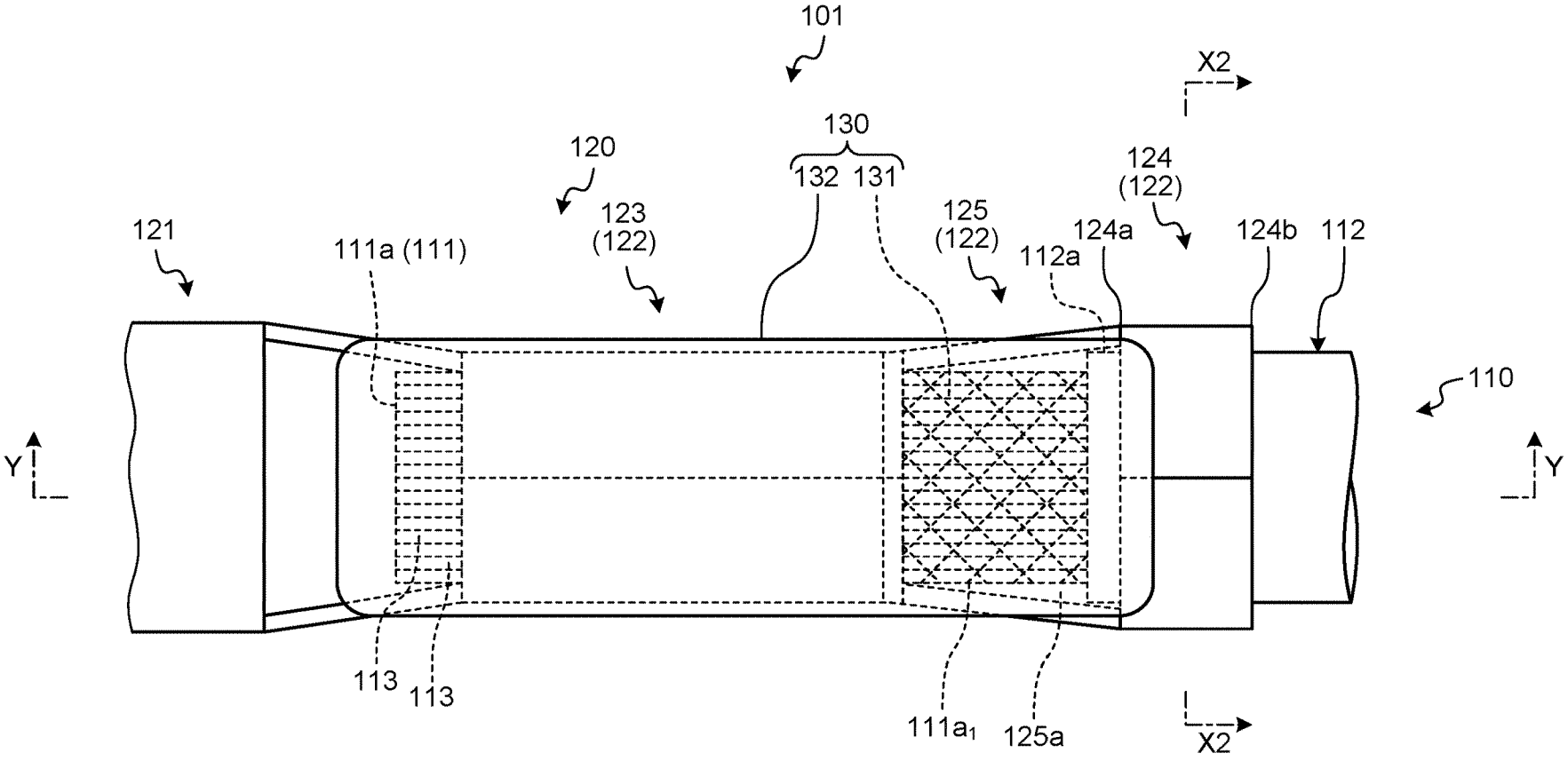
FIG. 5 is a top view illustrating an electric wire with a terminal.
Figure 6:
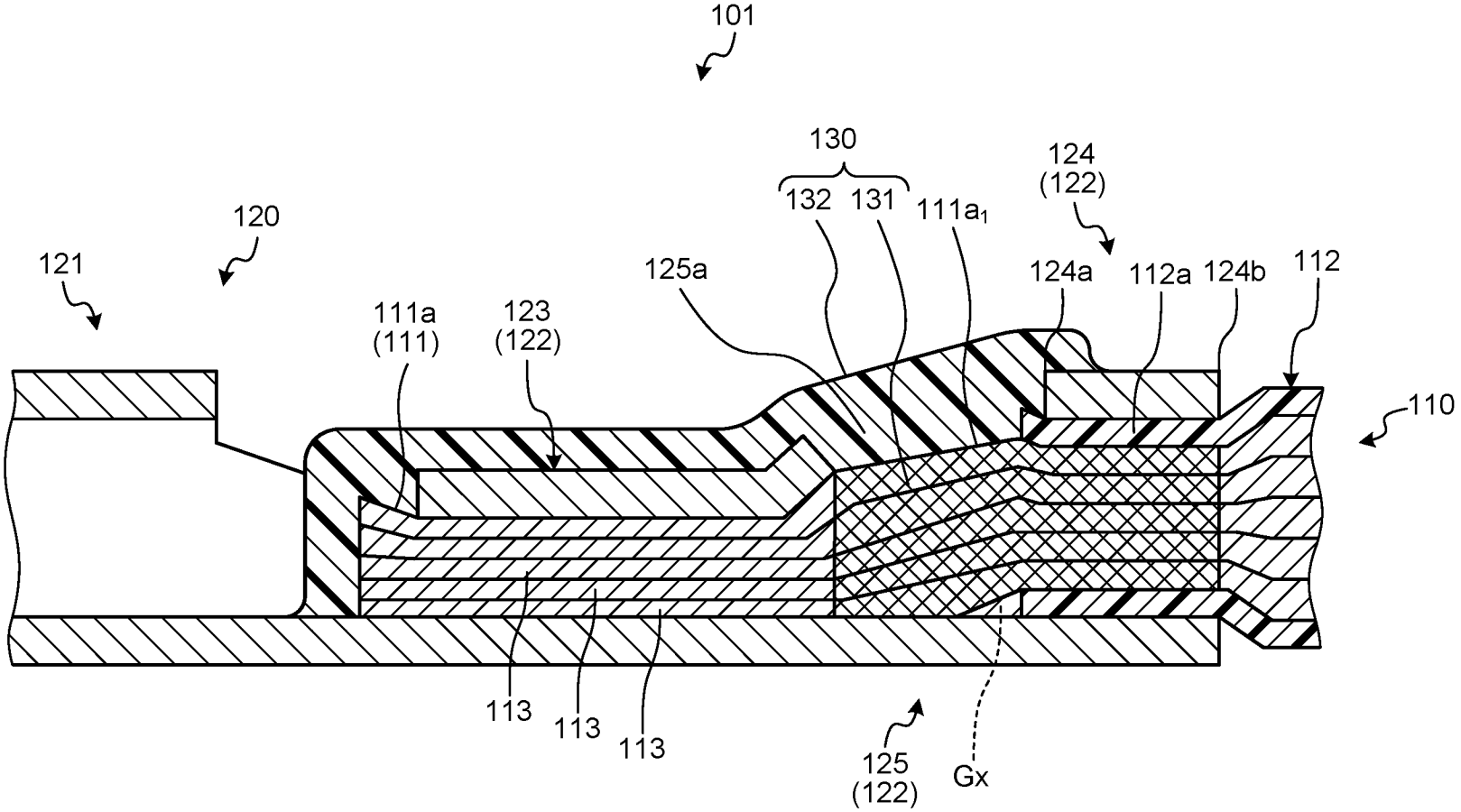
FIG. 6 is a cross-sectional view along the line Y-Y in FIG. 5.

The coupling body 125 described herein mainly couples the bottom part 123A of the core wire connection body 123 with the bottom part 124A of the coating connection body 124, and exposes the core wire exposed part 111*a* between the respective barrel piece parts 123B and 124B of the core wire connection body 123 and the coating connection body 124 after being caulked and crimped (FIG. 5 and FIG. 6). In the electric wire connection body 122 described herein after being caulked and crimped, the coupling body 125 includes an opening 125*a* between the core wire connection body 123 and the coating connection body 124 (FIG. 3 to FIG. 6). In the coupling body 125 described herein, a cross section orthogonal to an axial direction of the core wire exposed part 111*a* has a U-shape, and the core wire exposed part 111*a* is exposed from the U-shaped opening 125*a*. After being caulked and crimped, an exposed part $\mathbf{111}a_1$ of the core wire exposed part 111*a* is exposed from the opening 125*a*.

In this case, the elemental wire 113 of the core wire 111 and the terminal metal fitting 120 may be formed of the same metallic material, or may be formed of different metallic materials. The elemental wire 113 and the terminal metal fitting 120 described herein are formed of metallic materials having different ionization tendencies, one of the ionization tendencies is larger than the other one thereof. In this example, the elemental wire 113 is made of aluminum or aluminum alloy, and the terminal metal fitting 120 is made of copper or copper alloy having a smaller ionization tendency than that of the elemental wire 113.

The water stop member 130 is disposed at least between a distal end of the core wire exposed part 111*a* and a rear end 124*b* of the coating connection body 124 to enhance anti-corrosive performance of the connection part between the electric wire 110 and the terminal metal fitting 120 (FIG. 5 and FIG. 6). The water stop member 130 is formed by curing a curable resin material having viscosity. The water stop member 130 is formed after the electric wire 110 is connected to the terminal metal fitting 120 by caulking and crimping as described above. That is, the water stop member 130 is formed on an electric wire with a terminal 101X as a semifinished product obtained by connecting the electric wire 110 with the terminal metal fitting 120 (FIG. 1 and FIG. 3).

The water stop member 130 at least includes an inner water stop part 131 formed in gaps G (FIG. 4 and FIG. 7) between all or part of the elemental wires 113 at least at the core wire exposed part 111*a*, and an outer water stop part 132 that covers the core wire exposed part 111*a* from the outside together with the core wire connection body 123 and the coating connection body 124 (FIG. 5 and FIG. 6). For convenience of illustration, an area in which the inner water stop part 131 in FIG. 5 and FIG. 6 is formed is represented by cross hatching. The outer water stop part 132 in the drawings is conceptually represented, and the shape thereof is not limited to the shape in the drawings.

The inner water stop part 131 is formed to prevent liquid such as water or salt water from flowing into the gaps G between the elemental wires 113. Thus, the inner water stop part 131 is formed of a curable resin material for internal use 131X (FIG. 4) capable of infiltrating into the gaps G between the elemental wires 113 and capable of being fixed to the gap G until being cured. On the other hand, the outer water stop part 132 is formed to prevent liquid from adhering to the core wire exposed part 111*a* from the outside. Thus, the outer water stop part 132 is formed of a curable resin material for external use having high viscosity that can continuously cover the core wire exposed part 111*a* until being cured. The curable resin material for internal use 131X and the curable resin material for external use may be the same type of curable resin material, or may be different types of curable resin materials. As the curable resin material for internal use 131X and the curable resin material for external use described herein, the same type of curable resin material is used.

Figure 7:
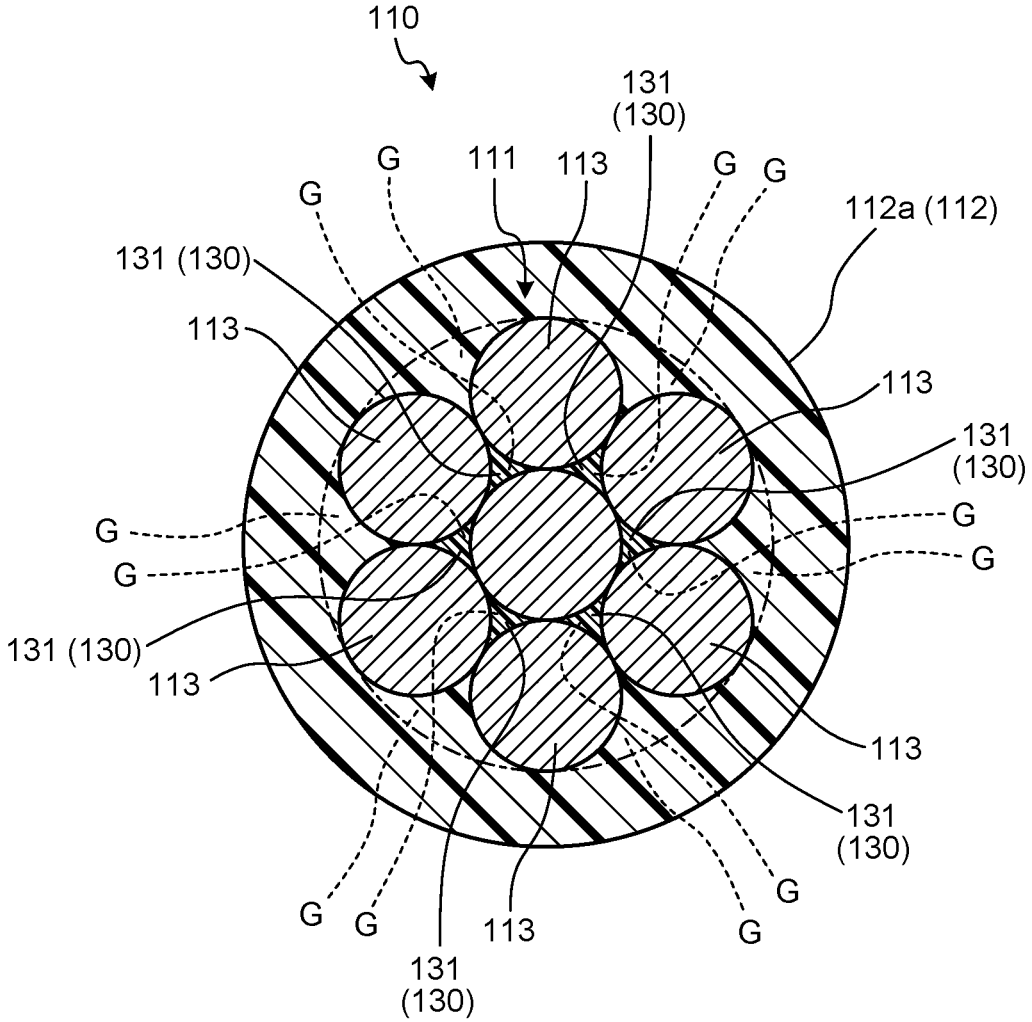
FIG. 7 is an explanatory diagram illustrating a cross section along the line X2-X2 of the electric wire in FIG. 5.

The inner water stop part 131 described herein is formed in the gaps G between the elemental wires 113 of the core wire 111 at least in an area from the position of the coupling body 125 to the position of the rear end 124*b* (rear end position) opposite to the position of the distal end 124*a* (distal end position) on the coupling body 125 side of the coating connection body 124 (FIG. 4, FIG. 6, and FIG. 7). The inner water stop part 131 is formed to prevent liquid such as water or salt water from flowing into the gaps G between the elemental wires 113 in the area described above. The inner water stop part 131 is formed in the gaps G between the elemental wires 113 inside the core wire 111, and the gaps G between the elemental wires 113 on an outer peripheral surface side of the core wire 111.

FIG. 7 illustrates an example of the inner water stop part 131 inside the coating connection body 124. For example, in the coating terminal part 112*a*, the inner peripheral surface side thereof may get into the gaps G between the elemental wires 113 on an outer peripheral surface side of the core wire 111 by being pressurized by the coating connection body 124 to fill up the gaps G. In a case in which all of the gaps G between the elemental wires 113 on the outer peripheral surface side of the core wire 111 are filled with the coating terminal part 112*a* inside the coating connection body 124, as illustrated in FIG. 7, a plurality of the inner water stop parts 131 are formed in the gaps G between the elemental wires 113 inside the core wire 111. On the other hand, inside the coating connection body 124, in a case in which all of the gaps G or part of the gaps G between the elemental wires 113 on the outer peripheral surface side of the core wire 111 are not filled with the coating terminal part 112*a*, the inner water stop parts 131 are also formed in the gaps G between the elemental wires 113 not filled with the coating terminal part 112*a*.

The outer water stop part 132 is formed to cover the inner water stop parts 131 at the core wire exposed part 111*a* from the outside by covering the core wire exposed part 111*a* from the outside together with the core wire connection body 123 and the coating connection body 124 (FIG. 5 and FIG. 6).

The following describes a manufacturing method for the electric wire with a terminal 101, and the manufacturing device 1 used in the manufacturing method. In this example, from a terminal chain body (not illustrated) including a plurality of the terminal metal fittings 120 before the crimping process that are connected to each other at regular intervals, the terminal metal fitting 120 is fed out one by one, and the terminal metal fitting 120 is crimped onto the electric wire 110.

This manufacturing method includes a feed-out step for feeding out the terminal metal fittings 120 of the terminal chain body to a crimping position in order from a head. This feed-out step is performed by using a feed-out machine 10 of the manufacturing device 1 (FIG. 1). In this case, used is the feed-out machine 10 having a configuration that is known in this technical field. An operation of the feed-out machine 10 is controlled by a control device 91 (FIG. 1).

The terminal chain body is disposed in the feed-out machine 10, the terminal chain body obtained by winding up the terminal metal fittings 120 before the crimping process in a reel shape. The feed-out machine 10 draws out the terminal metal fitting 120 before the crimping process at the head on an outer peripheral side of the terminal chain body that is wound up in a reel shape, and successively feeds out the terminal metal fitting 120 toward the crimping position of a crimping machine 20 (described later) related to a latter step.

This manufacturing method further includes a crimping step for crimping the terminal metal fitting 120 before the crimping process onto the electric wire terminal 110*a* at the crimping position. At the crimping step, the electric wire connection body 122 of the terminal metal fitting 120 before the crimping process is crimped onto the electric wire terminal 110*a* to form the electric wire with a terminal 101X as a semifinished product in which the electric wire 110 is connected to the terminal metal fitting 120. This crimping step is performed by using the crimping machine 20 of the manufacturing device 1 (FIG. 1). In this case, used is the crimping machine 20 having a configuration that is known in this technical field. An operation of the crimping machine 20 is controlled by the control device 91 (FIG. 1).

In the crimping machine 20, the electric wire terminal 110*a* is placed on an inner wall surface of the electric wire connection body 122 of the terminal metal fitting 120 before the crimping process that is supplied to the crimping position, and the electric wire connection body 122 is caulked onto the electric wire terminal 110*a* to crimp the electric wire connection body 122 onto the electric wire terminal 110*a*. The crimping machine 20 described herein pressurizes and deforms the core wire connection body 123 of the electric wire connection body 122 to be caulked and crimped onto the core wire exposed part 111*a* of the electric wire 110, and pressurizes and deforms the coating connection body 124 of the electric wire connection body 122 to be caulked and crimped onto the coating terminal part 112*a* of the electric wire terminal 110*a*.

Figure 2:
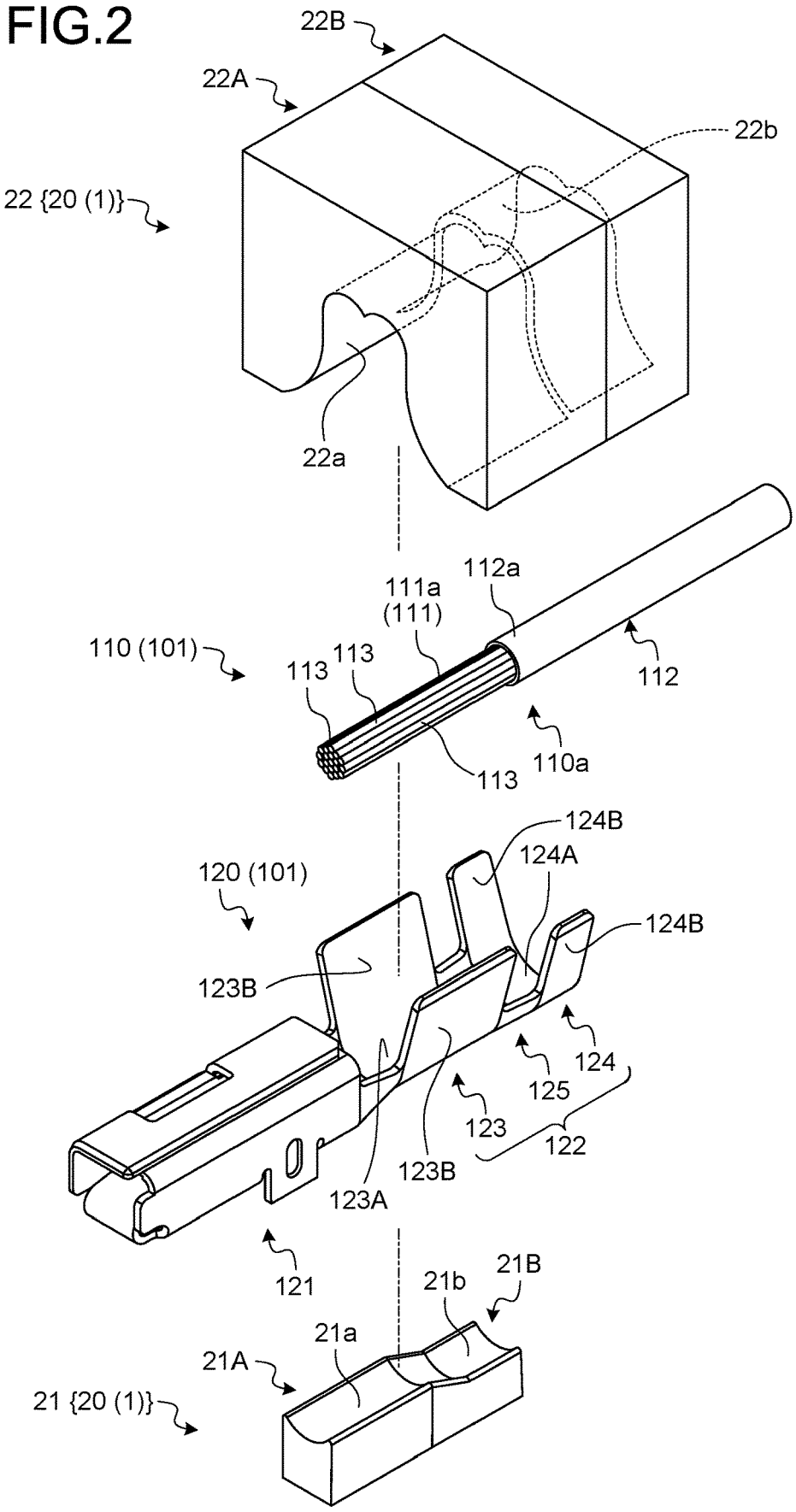
FIG. 2 is a perspective view illustrating a principal part of a crimping machine in the manufacturing device for an electric wire with a terminal.

The crimping machine 20 includes a first die 21 and a second die 22 holding therebetween the electric wire terminal 110*a* and the electric wire connection body 122 including the inner wall surface on which the electric wire terminal 110*a* is placed (FIG. 2). The first die 21 and the second die 22 sandwich and pressurize the electric wire terminal 110*a* and the electric wire connection body 122 including the inner wall surface on which the electric wire terminal 110*a* is placed to caulk and crimp the core wire connection body 123 onto the core wire exposed part 111*a*, and caulk and crimp the coating connection body 124 onto the coating terminal part 112*a*. In the crimping machine 20 described herein, the first die 21 is disposed as a female mold (anvil), and the bottom part 123A of the core wire connection body 123, the coupling body 125, and the bottom part 124A of the coating connection body 124 of the electric wire connection body 122 are placed on the first die 21. In the crimping machine 20 described herein, the second die 22 as a male mold (crimper) is disposed above the first die 21 with a gap.

The first die 21 and the second die 22 described herein respectively include first molding parts 21A and 22A for caulking and crimping the core wire connection body 123 onto the core wire exposed part 111*a*, and second molding parts 21B and 22B for caulking and crimping the coating connection body 124 onto the coating terminal part 112*a* (FIG. 2).

In this crimping machine 20, upper surfaces of the first molding part 21A and the second molding part 21B of the first die 21 are crimping positions, and the electric wire connection body 122 is placed at the crimping positions. In this crimping machine 20, the position of the first die 21 is fixed, and the second die 22 is vertically moved with respect to the first die 21 to crimp the electric wire connection body 122 at the crimping position onto the electric wire terminal 110*a*. At this point, in this crimping machine 20, the second die 22 is lowered toward the electric wire connection body 122 at the crimping position to pressurize and deform the electric wire connection body 122 between the first molding parts 21A and 22A and between the second molding parts 21B and 22B while the electric wire terminal 110*a* is placed on a bottom part of the electric wire connection body 122 (the bottom part 123A of the core wire connection body 123, the coupling body 125, and the bottom part 124A of the coating connection body 124).

A pressurizing surface 22*a* is formed on the first molding part 22A of the second die 22, the pressurizing surface 22*a* being arranged to be opposed to an upper surface 21*a* of the first molding part 21A of the first die 21 for causing a pair of the barrel piece parts 123B of the core wire connection body 123 to be pressurized and deformed while being slid (FIG. 2). The pressurizing surface 22*a* is formed in a shape corresponding to the shape of the core wire connection body 123 after being completely crimped. A pressurizing surface 22*b* is formed on the second molding part 22B of the second die 22, the pressurizing surface 22*b* being arranged to be opposed to an upper surface 21*b* of the second molding part 21B of the first die 21 for causing a pair of the barrel piece parts 124B of the coating connection body 124 to be pressurized and deformed while being slid (FIG. 2). The pressurizing surface 22*b* is formed in a shape corresponding to the shape of the coating connection body 124 after being completely crimped. The crimping machine 20 includes a power transmission mechanism that causes the second die 22 to vertically move with respect to the first die 21 with a constant stroke (not illustrated).

At the crimping step using the crimping machine 20, the first molding part 22A of the second die 22 is lowered toward the core wire connection body 123 placed on the upper surface 21*a* of the first molding part 21A of the first die 21 to caulk and crimp the core wire connection body 123 onto the core wire exposed part 111*a* while the core wire exposed part 111*a* of the electric wire 110 is placed on the inner wall surface of the bottom part 123A of the core wire connection body 123. Furthermore, at this crimping step, the second molding part 22B of the second die 22 is lowered toward the coating connection body 124 placed on the upper surface 21*b* of the second molding part 21B of the first die 21 to caulk and crimp the coating connection body 124 onto the coating terminal part 112*a* while the coating terminal part 112*a* of the electric wire 110 is placed on the inner wall surface of the bottom part 124A of the coating connection body 124.

Furthermore, this manufacturing method includes a cutting-off step for cutting off the terminal metal fitting 120 after being crimped from the terminal chain body after the crimping step is finished. This cutting-off step may be performed by using a cutting machine 30 (FIG. 1), or may be performed by an operator. In a case of using the cutting machine 30, the cutting machine 30 is disposed as one of constituent elements of the manufacturing device 1, and an operation thereof is controlled by the control device 91 (FIG. 1).

With the manufacturing method and the manufacturing device 1, the electric wire with a terminal 101X as a semifinished product is formed as described above. With the manufacturing method and the manufacturing device 1, the inner water stop part 131 and the outer water stop part 132 of the water stop member 130 are formed on the electric wire with a terminal 101X as a semifinished product.

In this manufacturing method, the inner water stop part 131 and the outer water stop part 132 may be formed on the electric wire with a terminal 101X at the same time, or the outer water stop part 132 may be formed after the inner water stop part 131 is formed. That is, in this manufacturing method, after the curable resin material for internal use 131X and the curable resin material for external use are supplied to the electric wire with a terminal 101X as a semifinished product, the curable resin material for internal use 131X and the curable resin material for external use may be collectively cured to form the inner water stop part 131 and the outer water stop part 132 at the same time. In this manufacturing method, after the curable resin material for internal use 131X is supplied to the electric wire with a terminal 101X as a semifinished product to form the inner water stop part 131 by curing the curable resin material for internal use 131X, the curable resin material for external use may be supplied, and the curable resin material for external use may be cured to form the outer water stop part 132. In this example, the inner water stop part 131 and the outer water stop part 132 are formed at the same time.

This manufacturing method includes a first resin supplying step for supplying the curable resin material for internal use 131X constituting the inner water stop part 131, to the electric wire with a terminal 101X as a semifinished product, and a second resin supplying step for supplying the curable resin material for external use constituting the outer water stop part 132, to the electric wire with a terminal 101X as a semifinished product. The first resin supplying step and the second resin supplying step are performed by using a resin supply machine 40 of the manufacturing device 1 (FIG. 1). In this case, used is the resin supply machine 40 having a configuration that is known in this technical field. An operation of the resin supply machine 40 is controlled by a control device 92 (FIG. 1).

The resin supply machine 40 includes a nozzle 41 for discharging the curable resin material for internal use 131X and the curable resin material for external use through a discharge port 41*b* at a nozzle distal end 41*a* (FIG. 1, FIG. 3, and FIG. 4). The resin supply machine 40 may cause the curable resin material for internal use 131X and a curable resin material for external use of a type different from the curable resin material for internal use 131X to be discharged through the discharge port 41*b*, or may cause the curable resin material for internal use 131X and a curable resin material for external use of the same type as the curable resin material for internal use 131X to be discharged through the discharge port 41*b*. However, in the former case, the nozzle 41 and the like need to be replaced or cleaned in switching between the curable resin material for internal use 131X and the curable resin material for external use. Thus, the resin supply machine 40 described herein causes the curable resin material for internal use 131X and a curable resin material for external use of the same type as the curable resin material for internal use 131X to be discharged through the discharge port 41*b*.

The resin supply machine 40 discharges the curable resin material for internal use 131X through the discharge port 41*b* at the nozzle distal end 41*a* while pressing the nozzle distal end 41*a* of the nozzle 41 against an exposed part exposed from the electric wire connection body 122 at the core wire exposed part 111*a* after being caulked and crimped, and infiltrate the curable resin material for internal use 131X into the gaps G while pressing out air in the gaps G between the elemental wires 113 at least at the core wire exposed part 111*a*. For example, the resin supply machine 40 infiltrates the curable resin material for internal use 131X into the gaps G between all or part of the elemental wires 113 in an axial direction of the core wire 111 at the core wire exposed part 111*a*.

In the resin supply machine 40, used is the nozzle 41 in which inner diameters of the discharge port 41*b* having a circular shape and a path to the discharge port 41*b* are equal to or larger than 0.1 mm depending on a discharge pressure of the curable resin material for internal use 131X or viscosity of the curable resin material for internal use 131X. Additionally, the resin supply machine 40 discharges the curable resin material for internal use 131X through the discharge port 41*b* at a discharge pressure for enabling the curable resin material for internal use 131X to be infiltrated into the gaps G between the elemental wires 113. However, if the discharge pressure is too high, a film of the curable resin material for internal use 131X is generated on a surface of the exposed part of the core wire exposed part 111*a* before the curable resin material for internal use 131X is infiltrated into the gaps G between the elemental wires 113, so that the discharge pressure is preferably adjusted in accordance with the viscosity of the curable resin material for internal use 131X while considering the above point.

In the electric wire with a terminal 101X as a semifinished product, as the exposed part of the core wire exposed part 111*a* against which the nozzle distal end 41*a* is pressed, there are a distal end portion of the core wire exposed part 111*a* projected from a distal end on the terminal connection body 121 side of the core wire connection body 123, and a portion exposed from the opening 125*a* of the coupling body 125 in the core wire exposed part 111*a* (exposed part 111$a_1$). At the first resin supplying step described herein, the curable resin material for internal use 131X is discharged through the discharge port 41*b* while the nozzle distal end 41*a* is pressed against the exposed part 111$a_1$ of the core wire exposed part 111*a* exposed from the opening 125*a* of the coupling body 125.

The nozzle 41 used herein includes the nozzle distal end 41*a* smaller than the opening 125*a* of the coupling body 125 to infiltrate the curable resin material for internal use 131X into the gaps G between the elemental wires 113 while pressing out air from the gaps G with the curable resin material for internal use 131X at the time when the curable resin material for internal use 131X is discharged through the discharge port 41*b* while the nozzle distal end 41*a* is pressed against the exposed part 111$a_1$ (FIG. 3 and FIG. 4). That is, in the resin supply machine 40, used is the nozzle 41 including the nozzle distal end 41*a* the area of which is smaller than the area of the opening 125*a* of the coupling body 125. The area of the nozzle distal end 41*a* means an area of a portion of the nozzle distal end 41*a* to be pressed against the exposed part 111$a_1$. For example, in a case of the nozzle 41 having a cylindrical shape, the area is an area of a circle obtained from an outer diameter of the nozzle 41.

For example, regarding the resin supply machine 40, a difference between the area of the nozzle distal end 41*a* and the area of the opening 125*a* for enabling air in the gaps G between the elemental wires 113 to be pressed out with the curable resin material for internal use 131X is obtained based on a required discharge pressure for the curable resin material for internal use 131X, a required discharge time for the curable resin material for internal use 131X, viscosity of the curable resin material for internal use 131X, and volume of the gaps G between the elemental wires 113 in which the curable resin material for internal use 131X is filled, and the nozzle 41 including the nozzle distal end 41*a* corresponding to the difference is used.

As in this example, in a case in which the distal end of the coating terminal part 112*a* is projected toward the coupling body 125 side from the distal end 124*a* of the coating connection body 124 after being caulked and crimped, while considering an area occupied by a projecting portion of the coating terminal part 112*a* (coated area) at the opening 125*a* of the coupling body 125, the coated area is subtracted from the area of the opening 125*a*, and the nozzle 41 including the nozzle distal end 41*a* having an area smaller than a subtraction value thereof is used (FIG. 3).

At the first resin supplying step, the curable resin material for internal use 131X is infiltrated into the gaps G between the elemental wires 113 at the exposed part 111$a_1$ of the core wire exposed part 111*a*, and the curable resin material for internal use 131X is filled into the gaps G between the elemental wires 113 at the exposed part 111$a_1$ and the gaps G between the elemental wires 113 around the exposed part 111$a_1$. At the first resin supplying step described herein, the curable resin material for internal use 131X is filled into the gaps G between the elemental wires 113 of the core wire 111 at least between the position of the coupling body 125 to a rear end position of the coating connection body 124. That is, the curable resin material for internal use 131X is filled into at least the gaps G between the elemental wires 113 at the exposed part 111$a_1$ and the gaps G between the elemental wires 113 of the core wire 111 inside the coating terminal part 112*a*. For example, at the first resin supplying step, the curable resin material for internal use 131X is filled into the gaps G between the elemental wires 113 by discharging the curable resin material for internal use 131X through the discharge port 41*b* while orienting the discharge port 41*b* at the nozzle distal end 41*a* toward the inside of the coating terminal part 112*a* from the exposed part 111$a_1$.

At the first resin supplying step, in a case in which a gap Gx (FIG. 4 and FIG. 6) is present between the exposed part 111$a_1$ and the coupling body 125, the curable resin material for internal use 131X is also filled into the gap Gx between the exposed part 111$a_1$ and the coupling body 125.

Next, at the second resin supplying step, the resin supply machine 40 separates the nozzle distal end 41*a* from the exposed part of the core wire exposed part 111*a*, and discharges the curable resin material for external use through the discharge port 41*b* at the nozzle distal end 41*a* to cover the core wire exposed part 111*a* in which the curable resin material for internal use 131X is filled into the gaps G between the elemental wires 113, the core wire connection body 123, and the coating connection body 124 from the outside with the curable resin material for external use. That is, at the second resin supplying step, the curable resin material for external use is discharged through the discharge port 41*b* in a state of separating the nozzle distal end 41*a* from the electric wire with a terminal 101X as a semifinished product so that the curable resin material for internal use 131X in the gaps G between the elemental wires 113 is prevented from being pressed out with the curable resin material for external use.

At the second resin supplying step described herein, the curable resin material for external use is applied to an area between the distal end of the core wire exposed part 111*a* and the distal end 124*a* of the coating connection body 124 while being discharged through the discharge port 41*b*, and the area between the distal end of the core wire exposed part 111*a* and the distal end 124*a* of the coating connection body 124 is covered with the curable resin material for external use from the outside. At this point, if the opening 125*a* side of the coupling body 125 is defined as an upper side, the curable resin material for external use is applied within a range of preventing the curable resin material for external use from being squeezed out toward a lateral side of the terminal metal fitting 120.

Additionally, the manufacturing method includes a resin curing step for curing the curable resin material for internal use 131X and the curable resin material for external use that are supplied to the electric wire with a terminal 101X as a semifinished product. The resin curing step is performed by using a resin curing device 50 of the manufacturing device 1 (FIG. 1). In this case, the resin curing device 50 having a configuration that is known in this technical field is used in accordance with how to cure the curable resin material. An operation of the resin curing device 50 is controlled by the control device 92 (FIG. 1).

For example, as the curable resin material, used is a UV curable resin material having viscosity that is cured by being irradiated with ultraviolet rays, or a one-component heat curable resin material having viscosity that is cured being heated. As the curable resin material for internal use 131X and the curable resin material for external use described herein, the UV curable resin material is used. Thus, as the resin curing device 50 described herein, an ultraviolet irradiation device is used. At this resin curing step, the resin curing device 50 is operated to irradiate the curable resin material for internal use 131X with ultraviolet rays from the outside, and the curable resin material for internal use 131X and the curable resin material for external use are cured to form the inner water stop part 131 made of the curable resin material for internal use 131X and the outer water stop part 132 made of the curable resin material for external use.

With the manufacturing method and the manufacturing device 1, the electric wire with a terminal 101 is formed as described above.

In a case of viewing the inner water stop part 131 and the outer water stop part 132 as the water stop member 130, a boundary therebetween can be hardly identified if each of the inner water stop part 131 and the outer water stop part 132 is transparent or semi-transparent. Thus, regarding the manufacturing method for the electric wire with a terminal and the manufacturing device 1 for the electric wire with a terminal, for example, a coloring agent may be added to the curable resin material for internal use 131X constituting the inner water stop part 131, and the curable resin material for external use constituting the outer water stop part 132 may be kept transparent or semi-transparent to enable the boundary between the inner water stop part 131 and the outer water stop part 132 to be identified. Accordingly, with the manufacturing method for the electric wire with a terminal and the manufacturing device 1 for the electric wire with a terminal, it is possible to visually determine whether the inner water stop part 131 is present in the outer water stop part 132.

In this case, with a conventional manufacturing method for the electric wire with a terminal and manufacturing device for the electric wire with a terminal, the curable resin material for internal use is dripped onto the exposed part in a state in which the nozzle distal end is separated from the exposed part of the core wire exposed part. Due to this, with the conventional manufacturing method for the electric wire with a terminal and manufacturing device for the electric wire with a terminal, the curable resin material for internal use does not infiltrate into all of the gaps between the elemental wires and remains on the surface of the exposed part of the core wire exposed part unless viscosity of the curable resin material for internal use is lowered, and the remaining curable resin material for internal use may block the opening of the coupling body. However, when the curable resin material for internal use having viscosity to be easily infiltrated into the gaps between the elemental wires is used for the conventional manufacturing method for the electric wire with a terminal and manufacturing device for the electric wire with a terminal, even if the curable resin material for internal use is infiltrated into all of the gaps between the elemental wires, the curable resin material for internal use may get out of the gaps without remaining in all of the gaps between the elemental wires.

On the other hand, with the manufacturing method for the electric wire with a terminal and the manufacturing device 1 for the electric wire with a terminal according to the present embodiment, the curable resin material for internal use 131X is discharged through the discharge port 41*b* at the nozzle distal end 41*a* while the nozzle distal end 41*a* is pressed against the exposed part of the core wire exposed part 111*a* after being caulked and crimped, and the curable resin material for internal use 131X is infiltrated into the gaps G while air in the gaps G between the elemental wires 113 at least at the core wire exposed part 111*a* is pressed out. Due to this, with the manufacturing method for the electric wire with a terminal and the manufacturing device 1 for the electric wire with a terminal, the curable resin material for internal use 131X can be filled into all of the gaps G between the elemental wires 113. For example, with the manufacturing method for the electric wire with a terminal and the manufacturing device 1 for the electric wire with a terminal, even when a curable resin material having high viscosity (for example, required viscosity for the curable resin material for external use) is used as the curable resin material for internal use 131X, the curable resin material for internal use 131X can be filled into all of the gaps G between the elemental wires 113. With the manufacturing method for the electric wire with a terminal and the manufacturing device 1 for the electric wire with a terminal, after the curable resin material for internal use 131X is filled into all of the gaps G between the elemental wires 113, the curable resin material for external use is supplied thereon to cover the core wire exposed part 111*a*. With the manufacturing method for the electric wire with a terminal and the manufacturing device 1 for the electric wire with a terminal, the curable resin material for internal use 131X and the curable resin material for external use are cured to form the inner water stop parts 131 filling all of the gaps G between the elemental wires 113 at least at the core wire exposed part 111*a* and the outer water stop part 132 covering the core wire exposed part 111*a* from the outside. Thus, the manufacturing method for the electric wire with a terminal and the manufacturing device 1 for the electric wire with a terminal according to the present embodiment can produce the electric wire with a terminal 101 in which anticorrosive performance of the connection part between the electric wire 110 and the terminal metal fitting 120 is improved.

Additionally, with the manufacturing method for the electric wire with a terminal and the manufacturing device 1 for the electric wire with a terminal according to the present embodiment, the nozzle distal end 41*a* is smaller than the opening 125*a* of the coupling body 125, so that air pressed out from the gaps G between the elemental wires 113 can be released to the outside through a gap between the opening 125*a* of the coupling body 125 and the nozzle distal end 41*a* by discharging the curable resin material for internal use 131X through the discharge port 41*b* at the nozzle distal end 41*a* while the nozzle distal end 41*a* is pressed against the exposed part $\mathbf{111}a_1$ exposed from the electric wire connection body 122 at the core wire exposed part 111*a* after being caulked and crimped. Thus, the manufacturing method for the electric wire with a terminal and the manufacturing device 1 for the electric wire with a terminal according to the present embodiment can enhance filling efficiency of the curable resin material for internal use 131X for the gaps G between the elemental wires 113, so that it is possible to produce the electric wire with a terminal 101 in which anticorrosive performance of the connection part between the electric wire 110 and the terminal metal fitting 120 is improved.

Furthermore, with the manufacturing method for the electric wire with a terminal and the manufacturing device 1 for the electric wire with a terminal according to the present embodiment, the inner water stop part 131 is formed in the core wire 111 of the electric wire terminal 110*a* to fill the gaps G between the elemental wires 113 not only at the core wire exposed part 111*a* but also inside the coating terminal part 112*a* up to a rear end position of the coating connection body 124. Thus, the manufacturing method for the electric wire with a terminal and the manufacturing device 1 for the electric wire with a terminal according to the present embodiment can produce the electric wire with a terminal 101 in which anticorrosive performance of the connection part between the electric wire 110 and the terminal metal fitting 120 is further improved. For example, regarding the manufacturing method for the electric wire with a terminal and the manufacturing device 1 for the electric wire with a terminal described herein, the elemental wire 113 and the terminal metal fitting 120 are made of different types of metals, but due to the inner water stop part 131, it is possible to produce the electric wire with a terminal 101 in which what is called galvanic corrosion can be prevented from occurring between the elemental wire 113 and the terminal metal fitting 120 even if the electric wire terminal 110*a* is immersed in liquid.

Regarding the electric wire with a terminal 101, there is the possibility that the terminal metal fitting 120 is housed in a cavity (not illustrated) of a connector without a waterproof function (non-waterproof connector), and a terminal metal fitting (not illustrated) without an anticorrosive function as an electric wire terminal opposite to the terminal metal fitting 120 is housed in a cavity (not illustrated) of a connector having a waterproof mechanism (waterproof connector). In the electric wire with a terminal 101, the non-waterproof connector side may be placed in a compartment, and the waterproof connector side may be placed outside the compartment. In this case, with the electric wire with a terminal 101, even if a negative pressure is generated inside the coating 112 due to a temperature difference between the inside of the compartment and the outside of the compartment, liquid is not sucked into the core wire exposed part 111*a* from the outside due to the water stop member 130, so that anticorrosive performance of the connection part between the electric wire 110 and the terminal metal fitting 120 can be maintained. In this way, the manufacturing method for the electric wire with a terminal and the manufacturing device 1 for the electric wire with a terminal according to the present embodiment can produce the electric wire with a terminal 101 having excellent durability.

In the electric wire with a terminal 101, anticorrosive performance of the connection part between the electric wire 110 and the terminal metal fitting 120 can be improved without causing the water stop member 130 to protrude to a lateral side of the terminal metal fitting 120. That is, the manufacturing method for the electric wire with a terminal and the manufacturing device 1 for the electric wire with a terminal according to the present embodiment can produce the electric wire with a terminal 101 in which anticorrosive performance of the connection part between the electric wire 110 and the terminal metal fitting 120 is improved without hindering insertion of the terminal metal fitting 120 into a cavity (not illustrated) of a connector and the like.

Furthermore, with the manufacturing method for the electric wire with a terminal and the manufacturing device 1 for the electric wire with a terminal according to the present embodiment, the same type of curable resin material can be used for the curable resin material for internal use 131X and the curable resin material for external use, so that switching work from the curable resin material for internal use 131X to the curable resin material for external use is not required, and man-hours can be reduced.

Figure 8:
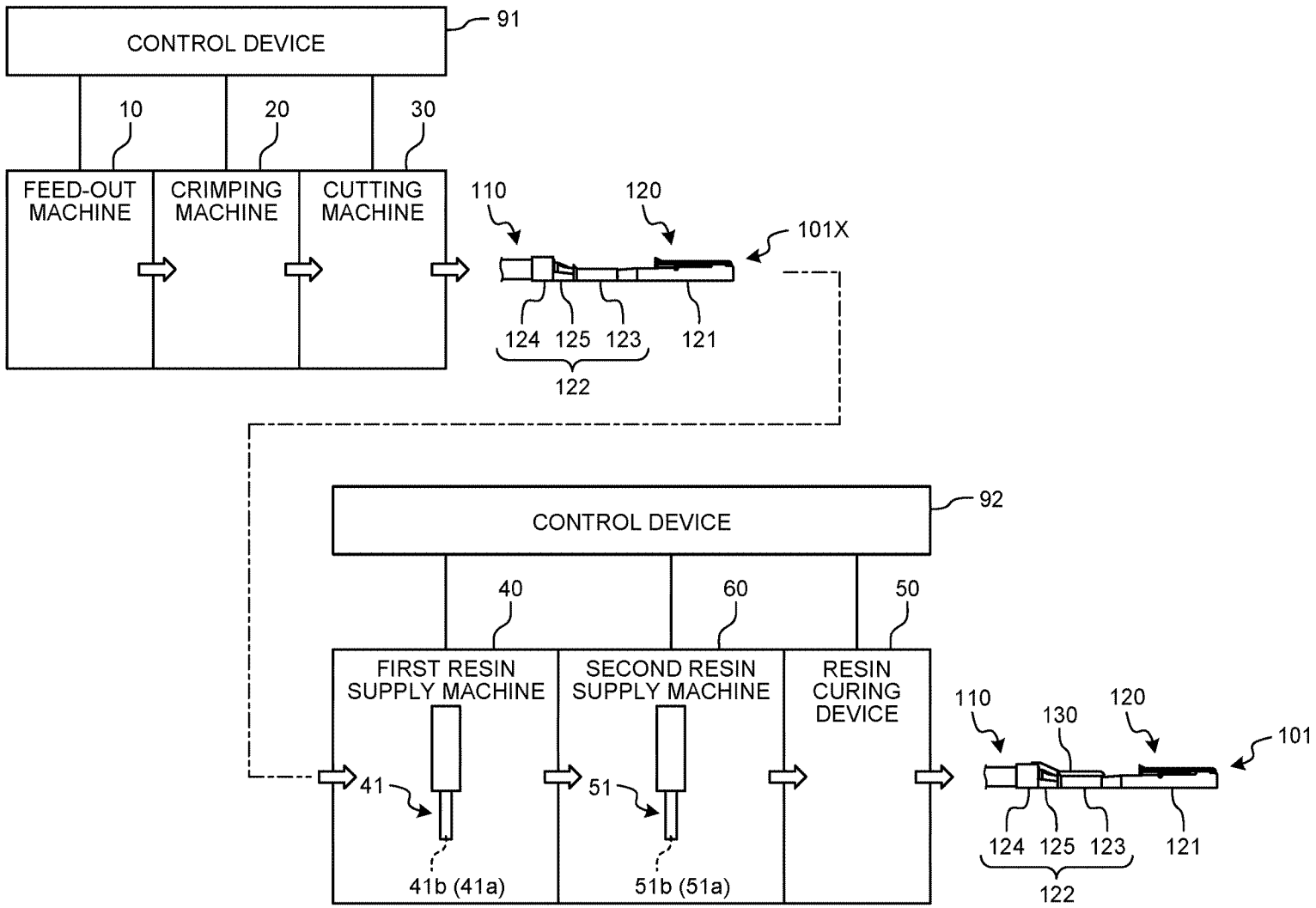
FIG. 8 is a block diagram illustrating a modification of the manufacturing device for an electric wire with a terminal.

In the examples described above, the curable resin material for internal use 131X and the curable resin material for external use are discharged from the same resin supply machine 40. However, in the manufacturing device 1, the curable resin material for internal use 131X and the curable resin material for external use may be respectively discharged from individual resin supply machines. For example, in the manufacturing device 1, in a case of using different types of curable resin materials for the curable resin material for internal use 131X and the curable resin material for external use, the resin supply machine (first resin supply machine) 40 described above is used only for the first resin supplying step. Thus, the first resin supply machine 40 discharges only the curable resin material for internal use 131X through the discharge port 41*b* of the nozzle (first nozzle) 41. A second resin supply machine 60 for discharging the curable resin material for external use is disposed in the manufacturing device 1 (FIG. 8). Thus, in the manufacturing method in this case, the first resin supplying step is performed by the first resin supply machine 40, and the second resin supplying step is performed by the second resin supply machine 60. An operation of the second resin supply machine 60 is controlled by the control device 92 (FIG. 8). The manufacturing device 1 in this case may be used when the curable resin material for internal use 131X and the curable resin material for external use are the same type of curable resin material.

The second resin supply machine 60 includes a second nozzle 61 for discharging the curable resin material for external use through a discharge port 61*b* at a nozzle distal end 61*a* (FIG. 8). The second resin supply machine 60 discharges the curable resin material for external use through the discharge port 61*b* at the nozzle distal end 61*a* of the second nozzle 61 to cover the core wire exposed part 111*a* in which the curable resin material for internal use 131X is filled into the gaps G between the elemental wires 113, the core wire connection body 123, and the coating connection body 124 with the curable resin material for external use from the outside. The second resin supply machine 60 discharges the curable resin material for external use through the discharge port 61*b* in a state in which the nozzle distal end 61*a* is separated from the electric wire with a terminal 101X as a semifinished product so that the curable resin material for internal use 131X in the gaps G between the elemental wires 113 is prevented from being pressed out with the curable resin material for external use. The second resin supply machine 60 is caused to perform the second resin supplying step by an operation similar to that of the resin supply machine 40 exemplified above. With the manufacturing method for the electric wire with a terminal and the manufacturing device 1 for the electric wire with a terminal according to the present embodiment, the same effect as exemplified above can be obtained even when such a device configuration is employed.

With the manufacturing method for the electric wire with a terminal and the manufacturing device for the electric wire with a terminal according to the present embodiment, the curable resin material for internal use is discharged through the discharge port at the nozzle distal end while the nozzle distal end is pressed against the exposed part of the core wire exposed part after being caulked and crimped, and the curable resin material for internal use is infiltrated into the gaps while air in the gaps between the elemental wires at least at the core wire exposed part is pressed out. Due to this, with the manufacturing method for the electric wire with a terminal and the manufacturing device for the electric wire with a terminal, the curable resin material for internal use can be filled into all of the gaps between the elemental wires. With the manufacturing method for the electric wire with a terminal and the manufacturing device for the electric wire with a terminal, after the curable resin material for internal use is filled into all of the gaps between the elemental wires, the curable resin material for external use is supplied thereon to cover the core wire exposed part. With the manufacturing method for the electric wire with a terminal and the manufacturing device for the electric wire with a terminal, the curable resin material for internal use and the curable resin material for external use are cured to form the inner water stop parts filling all of the gaps between the elemental wires at least at the core wire exposed part, and the outer water stop part covering the core wire exposed part from the outside. Accordingly, the manufacturing method for the electric wire with a terminal and the manufacturing device for the electric wire with a terminal according to the present embodiment can produce the electric wire with a terminal in which anticorrosive performance of the connection part between the electric wire and the terminal metal fitting is improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A manufacturing method for an electric wire with a terminal, the manufacturing method comprising:

a crimping step for sandwiching and pressurizing, with a first die and a second die, an electric wire terminal of an electric wire including a core wire constituted of a plurality of elemental wires and a coating covering the core wire and an electric wire connection body of a terminal metal fitting including an inner wall surface on which the electric wire terminal is placed, calking and crimping a core wire connection body of the electric wire connection body onto a core wire exposed part of the core wire of the electric wire terminal, and calking and crimping a coating connection body connected to the core wire connection body of the electric wire connection body via a coupling body onto a coating terminal part of the coating of the electric wire terminal;

a first resin supplying step for discharging a curable resin material for internal use through a discharge port at a nozzle distal end while pressing the nozzle distal end against an exposed part exposed from the electric wire connection body at the core wire exposed part after being caulked and crimped, and infiltrating the curable resin material for internal use into gaps between the elemental wires while pressing out air in the gaps at least at the core wire exposed part;

a second resin supplying step for discharging a curable resin material for external use through the discharge port at the nozzle distal end to cover the core wire exposed part in which the curable resin material for internal use is filled into the gaps between the elemental wires, the core wire connection body, and the coating connection body, with the curable resin material for external use from the outside; and a resin curing step for curing the curable resin material for internal use and the curable resin material for external use by operating a resin curing device.

2. The manufacturing method for the electric wire with a terminal according to claim 1, wherein at the first resin supplying step, the curable resin material for internal use is discharged through the discharge port at the nozzle distal end while the nozzle distal end smaller than an opening of the coupling body is pressed against the exposed part exposed from the opening.

3. The manufacturing method for the electric wire with a terminal according to claim 2, wherein at the first resin supplying step, the curable resin material for internal use is filled into the gaps between the elemental wires of the core wire at least in an area from a position of the coupling body to a rear end position opposite to a distal end position on the coupling body side of the coating connection body.

4. The manufacturing method for the electric wire with a terminal according to claim 1, wherein at the first resin supplying step, the curable resin material for internal use is filled into the gaps between the elemental wires of the core wire at least in an area from a position of the coupling body to a rear end position opposite to a distal end position on the coupling body side of the coating connection body.

5. A manufacturing method for an electric wire with a terminal, the manufacturing method comprising:

a crimping step for sandwiching and pressurizing, with a first die and a second die, an electric wire terminal of an electric wire including a core wire constituted of a plurality of elemental wires and a coating covering the core wire and an electric wire connection body of a terminal metal fitting including an inner wall surface on which the electric wire terminal is placed, calking and crimping a core wire connection body of the electric wire connection body onto a core wire exposed part of the core wire of the electric wire terminal, and calking and crimping a coating connection body connected to the core wire connection body of the electric wire connection body via a coupling body onto a coating terminal part of the coating of the electric wire terminal;

a first resin supplying step for discharging a curable resin material for internal use through a discharge port at a nozzle distal end of a first nozzle while pressing the nozzle distal end against an exposed part exposed from the electric wire connection body at the core wire exposed part after being caulked and crimped, and infiltrating the curable resin material for internal use into gaps between the elemental wires while pressing out air in the gaps at least at the core wire exposed part;

a second resin supplying step for discharging a curable resin material for external use through a discharge port at a nozzle distal end of a second nozzle to cover the core wire exposed part in which the curable resin material for internal use is filled into the gaps between the elemental wires, the core wire connection body, and the coating connection body with the curable resin material for external use from the outside; and a resin curing step for curing the curable resin material for internal use and the curable resin material for external use by operating a resin curing device.

6. The manufacturing method for the electric wire with a terminal according to claim 5, wherein at the first resin supplying step, the curable resin material for internal use is discharged through the discharge port at the nozzle distal end while the nozzle distal end smaller than an opening of the coupling body is pressed against the exposed part exposed from the opening.

7. The manufacturing method for the electric wire with a terminal according to claim 6, wherein at the first resin supplying step, the curable resin material for internal use is filled into the gaps between the elemental wires of the core wire at least in an area from a position of the coupling body to a rear end position opposite to a distal end position on the coupling body side of the coating connection body.

8. The manufacturing method for the electric wire with a terminal according to claim 5, wherein at the first resin supplying step, the curable resin material for internal use is filled into the gaps between the elemental wires of the core wire at least in an area from a position of the coupling body to a rear end position opposite to a distal end position on the coupling body side of the coating connection body.

9. A manufacturing device for an electric wire with a terminal, the manufacturing device comprising:

a crimping machine that includes a first die and a second die between which an electric wire terminal of an electric wire including a core wire constituted of a plurality of elemental wires and a coating covering the core wire, and an electric wire connection body of a terminal metal fitting including an inner wall surface on which the electric wire terminal is placed are disposed, and is configured to sandwich and pressurize the electric wire terminal and the electric wire connection body with the first die and the second die to calk and crimp a core wire connection body of the electric wire connection body onto a core wire exposed part of the core wire of the electric wire terminal, and calk and crimp a coating connection body connected to the core wire connection body of the electric wire connection body via a coupling body onto a coating terminal part of the coating of the electric wire terminal;

a resin supply machine that includes a nozzle for discharging a curable resin material for internal use and a curable resin material for external use through a discharge port at a nozzle distal end, and is configured to discharge the curable resin material for internal use through the discharge port at the nozzle distal end while pressing the nozzle distal end of the nozzle against an exposed part exposed from the electric wire connection body at the core wire exposed part after being caulked and crimped, infiltrate the curable resin material for internal use into gaps between the elemental wires while pressing out air in the gaps at least at the core wire exposed part, and cover the core wire exposed part in which the curable resin material for internal use is filled into the gaps between the elemental wires, the core wire connection body, and the coating connection body with the curable resin material for external use from the outside; and a resin curing device configured to cure the curable resin material for internal use and the curable resin material for external use.

10. The manufacturing device for the electric wire with a terminal according to claim 9, wherein the nozzle distal end including the discharge port for the curable resin material for internal use is smaller than an opening of the coupling body from which the exposed part is exposed.

11. A manufacturing device for an electric wire with a terminal, the manufacturing device comprising:

a crimping machine that includes a first die and a second die between which an electric wire terminal of an electric wire including a core wire constituted of a plurality of elemental wires and a coating covering the core wire, and an electric wire connection body of a terminal metal fitting including an inner wall surface on which the electric wire terminal is placed are disposed, and is configured to sandwich and pressurize the electric wire terminal and the electric wire connection body with the first die and the second die to calk and crimp a core wire connection body of the electric wire connection body onto a core wire exposed part of the core wire of the electric wire terminal, and calk and crimp a coating connection body connected to the core wire connection body of the electric wire connection body via a coupling body onto a coating terminal part of the coating of the electric wire terminal;

a first resin supply machine that includes a first nozzle for discharging a curable resin material for internal use through a discharge port at a nozzle distal end, and is configured to discharge the curable resin material for internal use through the discharge port at the nozzle distal end while pressing the nozzle distal end of the first nozzle against an exposed part exposed from the electric wire connection body at the core wire exposed part after being caulked and crimped, and infiltrate the curable resin material for internal use into gaps between the elemental wires while pressing out air in the gaps at least at the core wire exposed part;

a second resin supply machine that includes a second nozzle for discharging a curable resin material for external use through a discharge port at a nozzle distal end, and is configured to discharge the curable resin material for external use through a discharge port at a nozzle distal end of the second nozzle, and cover the core wire exposed part in which the curable resin material for internal use is filled into the gaps between the elemental wires, the core wire connection body, and the coating connection body with the curable resin material for external use from the outside; and a resin curing device configured to cure the curable resin material for internal use and the curable resin material for external use.

12. The manufacturing device for the electric wire with a terminal according to claim 11, wherein the nozzle distal end including the discharge port for the curable resin material for internal use is smaller than an opening of the coupling body from which the exposed part is exposed.

* * * * *